US006065722A

United States Patent [19]

LeVasseur et al.

[11] Patent Number: 6,065,722

[45] Date of Patent: May 23, 2000

[54] BRACKET ASSEMBLY FOR TREE MOUNTED LIGHTING

[75] Inventors: Craig LeVasseur; Christopher J. Pahl, both of Westlake Village, Calif.

[73] Assignee: Lumiere Design & Manufacturing, Inc., Westlake Village, Calif.

[21] Appl. No.: 09/177,417

[22] Filed: Oct. 22, 1998

Related U.S. Application Data

[60] Provisional application No. 60/063,452, Oct. 29, 1997.

[51] Int. Cl.[7] ..... A47B 96/06

[52] U.S. Cl. ..... 248/230.8; 248/218.4; 248/219.4; 248/228.8

[58] Field of Search ..... 248/218.4, 219.2, 248/219.4, 230.8, 227.3, 228.8, 230.9; 24/68 R, 68 A, 135 R, 135 A, 136 B, 168, 163 R, 486, 569, 525; 182/187, 188

[56] References Cited

U.S. PATENT DOCUMENTS

| | | | |
|---|---|---|---|
| 1,214,251 | 1/1917 | Wurmnest | 119/800 |
| 2,491,290 | 12/1949 | Tinnerman | 24/16 R |
| 2,632,217 | 3/1953 | Flora | 24/16 PB |
| 2,865,591 | 12/1958 | Holinshead | 251/8 |
| 3,345,028 | 10/1967 | Lawrie | 248/230.8 |
| 3,535,751 | 10/1970 | Batchelor | 548/510 |
| 3,746,294 | 7/1973 | Johnston | 248/219.4 |
| 3,785,604 | 1/1974 | Steck | 248/231 |
| 4,462,065 | 7/1984 | Rhodes | 362/250 |
| 4,909,353 | 3/1990 | Govin et al. | 182/187 |
| 5,190,260 | 3/1993 | Daubenspeck | 248/313 |
| 5,307,966 | 5/1994 | Inaba et al. | 224/151 |
| 5,310,151 | 5/1994 | Engel | 248/230.8 |
| 5,311,967 | 5/1994 | Kennedy | 182/133 |
| 5,582,337 | 12/1996 | McPherson et al. | 224/660 |
| 5,740,591 | 4/1998 | Hopkins | 24/302 |

*Primary Examiner*—Ramon O. Ramirez
*Assistant Examiner*—David Heisey
*Attorney, Agent, or Firm*—John E. Wagner; Robert C. Smith

[57] ABSTRACT

An assembly for mounting a lighting fixture on a tree includes a mounting plate having a flat mounting surface and angled flanges on opposite sides of said surface with slots in the flanges. A metal strap is secured to one of said flanges, passed through a clutch in two layers leaving a take-up loop on the opposite side of the clutch from the mounting plate. The free end of the strap is wrapped around the tree and passed through a slot on the opposite flange, being doubled over upon itself and clamped down with a screw and locking plate. The free end of the strap is then secured to the adjacent band with a clamp. The clutch consists of a housing carrying a pair of blocks between which two layers of the strap are passed to provide a take-up loop. A screw secured to the housing is adjustable to set the pressure of the blocks against the strap sufficiently tight to hold the band on the tree but loose enough so that as the tree grows a length of band from the take-up loop is permitted to slip through the clutch to avoid scarring or damaging the tree. The take-up loop may be renewed in size by loosening the screw and locking plate and by passing some of the excess strap through the blocks of the clutch followed by tightening the screw and locking plate. This allows further expansion of the strap automatically with further growth of the tree.

14 Claims, 4 Drawing Sheets

BRACKET ASSEMBLY FOR TREE MOUNTED LIGHTING

REFERENCE TO RELATED APPLICATION

This non-provisional application claims priority to provisional application Ser. No. 60/063,452 filed Oct. 29, 1997.

BACKGROUND OF THE INVENTION

In the field of landscape lighting, most lighting fixtures are located at or near ground level employing attractive fixtures which blend into the landscape. Some fixtures are designed to light walkways. Some are designed to provide accent lighting for the ground level plants and some are designed to project light toward buildings or taller landscaping such as bushes and trees.

One of the more difficult applications for garden lighting is to provide an unobtrusive lighting fixture which directs light downward toward a garden scene. The use of a post or pole to support such a fixture often detracts from the beauty of the landscape scene for which the lighting was intended to enhance.

A more desirable approach, in such a case, is to use an existing tree as the support for the lighting fixture. Mounting of the fixture on a tree by an inserting a fastener into the tree may not be acceptable to horticulturists and landscape architects. A more desirable approach is to apply a band around the tree trunk or a branch with a bracket and secure the lighting fixture to the bracket.

One of the problems in attaching anything to a growing tree is accommodating the natural growth in diameter of the tree. One approach is to employ a padded strap in which the padding resiliency provides the only accommodation for tree growth. This may only allow one season's growth until the padding is compressed and the strapping begins to scar the tree. A second approach is the use of a manually adjustable strap which may or may not be padded. The problem with both of these approaches is that the expansion capability of resilient padding is limited and the manually adjusted band is soon forgotten and usually adjustment is attempted only after someone notices the band cutting into the tree trunk or branch and a scar already formed.

In some cases the band or strap has become embedded in the tree growth and is not even removable. Nearly everyone has encountered fencing wires or the like installed at an earlier date and the wire totally enclosed in the growth of a tree.

BRIEF DESCRIPTION OF THE INVENTION

Faced with the foregoing problem it appeared to us that the ideal approach to mounting lighting fixtures on a growing tree is to use a strap holding a bracket in which the strap length is automatically expanded with tree growth, with the tension on the strap adjustable. It would also be desirable if there is a clear visible indication from the ground of the time to make further adjustment.

We also contemplate that with the growth of the tree and the utilization of the automatically adjustable strap or band, that additional new growth reserves may be simply added to the strap assembly with nothing more than a screwdriver or wrench, and many more months of secure mounting of the lighting fixture results, without harm to the tree and, again, with a clear visual indication of when a further adjustment needs to be made.

These objectives are all accomplished in accordance with this invention which includes a fixture mounting bracket with a strap or band secured to one side of the bracket and extending around a tree trunk or branch to be secured to the other side of the bracket. Somewhere in the loop of the strap or band is an adjustable clutch or tensioning device which defines a secondary or take-up loop of the band or strap, visible outside of the tensioning device with the secondary loop constituting a reserve of band or strap for tree growth.

One end of the band or strap is secured to one edge of the bracket. The other or free end of the band is adjustably secured and lockable to the opposite edge of the bracket. The second or free end is folded back and secured by a clamp to the tree encircling band and available for additional expansion of the tree over and above the secondary loop.

The installation of the fixture holding system of this invention involves attaching the bracket with the band adjustment to the tree. The lighting fixture and/or ballast box is then easily bolted to the bracket and appropriate wiring completed. Sizing and adjusting the strap without the weight and ungainly characteristics of the fixture is an advantage to the user because this task is usually done at some distance from the ground. Fine tuning of the adjustments and focusing is the last step and is more easily done when the sequence is done in the order as described.

When the strap is mounted in the first step above, the expansion loop adjusted in size and the clutch adjustment is over tightened with more than necessary force to assure holding the weight of the fixture. Next, the fixture is hung on the strap and the strap adjusted for tree growth, the clutch is loosened until the fixture is noticed moving away from the tree. This will be the force that will hold the fixture to the tree and at the same time allow for easiest slippage of the strap to accommodate for tree growth.

Thereafter, the landscape manager need only glance at the size of the secondary loop every few months to see when its size is reduced to a predetermined amount, such as for example, two inches in diameter. At this point, the free end of the strap or band end is loosened, and the extra strap length is transferred to the secondary loop through the tensioning device. Thereafter the tension device is secured to the second or free end. The fixture is still secure and the tree is free from damage for many months to come.

BRIEF DESCRIPTION OF THE DRAWING

This invention may be more clearly understood from the following detailed description and by reference to the drawing in which.

DETAILED DESCRIPTION OF THE INVENTION

Figure 1:
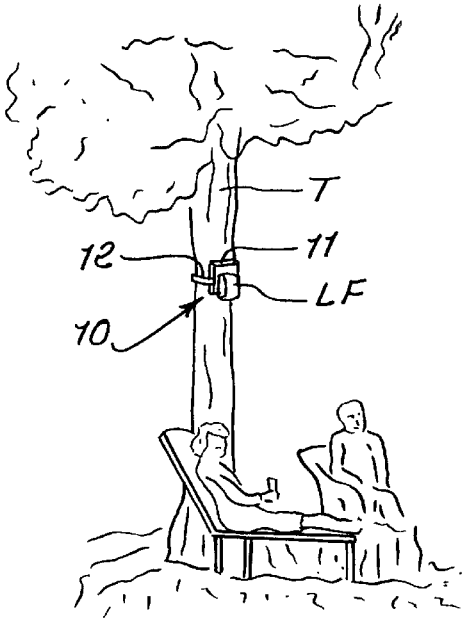
FIG. 1 is a perspective view of the typical garden setting employing this invention attached to a tree.

Reference is now made to FIG. 1 in combination with FIGS. 2 and 4–7. In FIG. 1, a typical residential garden scene appears with the dominant landscape feature, a tree, providing its natural beauty and daytime shade. At night, the same scene is desirably lighted from above in an unobtrusive way. The only practical elevated mount for the light source is the tree T. Attached to the tree T is the bracket assembly of this invention, generally designated 10, which comprises a bracket 11 with suitable attachment holes for mounting the lighting fixture LF of FIG. 1. The garden fixture may be any of a broad selection of exterior fixtures, for example, flood or spotlight with or without colored filters, whatever the landscape designer or property owner desires.

The lighting fixture LF is mounted high enough so that it is unobtrusive and yet effective. This characteristic of tree mounted lighting gives rise to the problem to which this invention is directed. Ideally the lighting fixture is utilized when energized but otherwise never noticed. The lack of attention drawn to the fixture is also reflected in the fact that the landscape manager or the residents or owner will seldom notice the effect upon the tree T of the bracket 11 and its associated strap or band 12. It is important that the fixture LF be supported rigidly for safety and with assurance that when once adjusted in direction that it does not move on its own. Therefore, the band 12 must be firmly secured around the tree T. This attachment, however, cannot be allowed to restrict the growth of the tree or scar it. The band 12 defines a primary or tree encircling loop 13 which is fixed at both sides of the bracket 11 and at another location, anywhere along the length of the primary loop 13, a tension adjustment device or clutch 14 which is shown as two rectangular blocks within U shaped holder 30, best seen in FIG. 7, including an adjustment screw 15, visible on the near side in FIG. 2. Beyond the tension adjusting device or clutch 14 is the secondary or take-up loop 16 of the band 12 which accommodates tree growth by reduction in size as is best illustrated in FIG. 3.

The adjustment screw 15 of FIGS. 2 and 4, 6 and 7 provides tension on a primary loop sufficient to hold the bracket 11 securely against the trunk of the tree T. Pressure developed by tree growth draws the loop 16 partially through the tension device 14 by overcoming the clutch pressure and friction of the rectangular blocks 32 and 33 of FIG. 7 to expand the size of the loop 13 by reducing the size of take-up loop 16.

Figure 3:
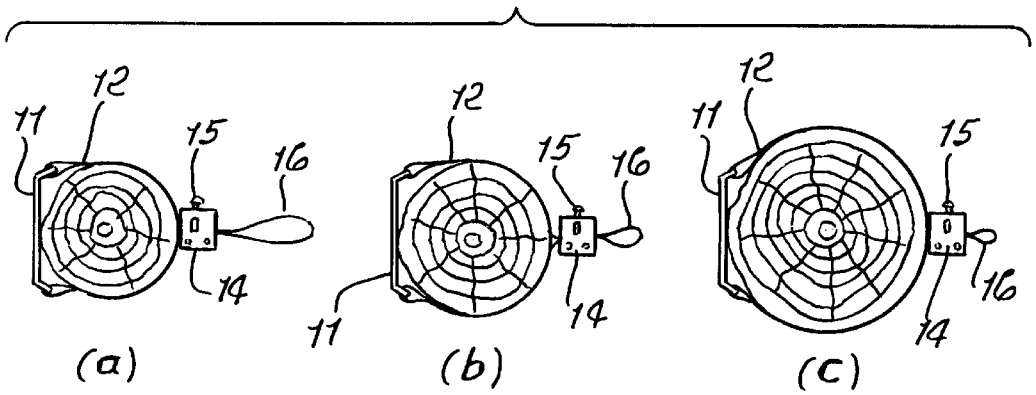
FIG. 3 is a series of transverse sectional views of a tree trunk showing natural growth over a number of years with the lighting fixture bracket of this invention attached and automatically adjusting to tree size without intervention of the landscape manager.

Now referring additionally to FIG. 3, one can see that a secondary loop 16 of approximately six inches in diameter when installed on an 8-inch diameter tree truck can accommodate approximately four inches of tree diameter growth before the loop 16 reaches the size of 2 inches in diameter as shown in FIG. 3*c* before any manual adjustments need be made by the landscape manager. This can be several years of growth.

Figure 2:
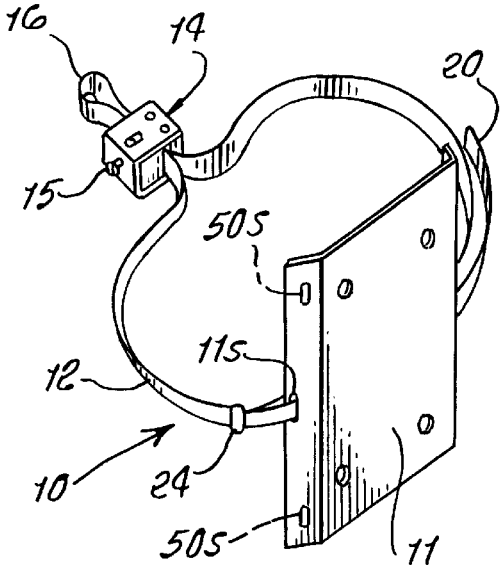
FIG. 2 is a perspective view of this invention ready for installation.

Barely noticed in FIG. 2 is free end 20 of the band 12 extending beyond one side of the bracket 11. This free end is normally secured to the adjacent section of the band 12 by clips or other means so that it does not tend to stand away from the tree trunk.

Figure 4:
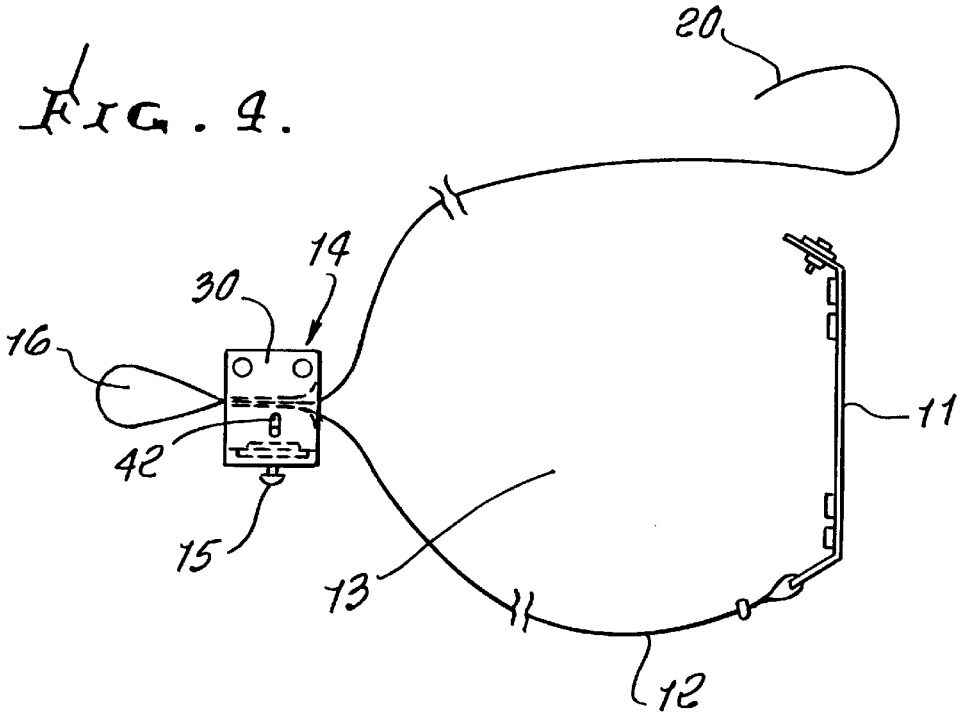
FIG. 4 is a top plan view of the bracket and strap assembly of this invention.
Figure 5:
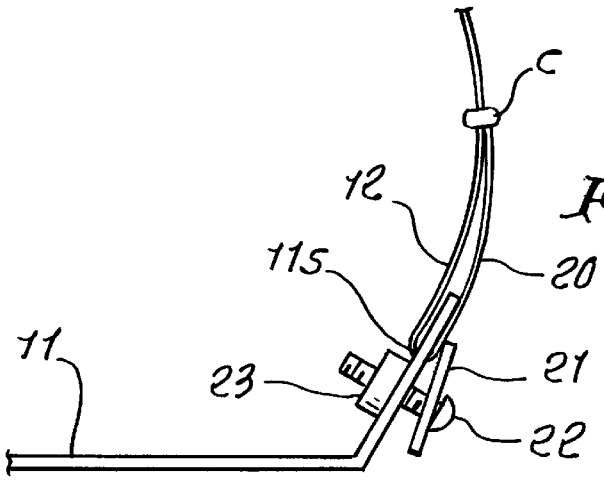
FIG. 5 is a fragmentary top plan view of the locking detail of the free end of the strap assembly of FIG. 4.

The free end 20 and its attachment to the bracket 11 are best seen in FIG. 4 in combination with FIG. 5. The bracket 11 includes a pair of slots 11*s*, only one of which appears in FIG. 2. The second such slot may be seen at least insofar as its location is concerned in FIG. 5 where the band 12 passes through slot 11*s* producing free end 20 secured by clip C. The free end 20 as well as the loop 13 are secured by a locking plate 21 which is tightened against the bracket 11 by screw 22.

Typically, the band 12 is type 304 spring tempered stainless-steel coil of 1.0 inch width and 0.012 inches in thickness to have sufficient strength for any practical sized garden fixture yet sufficient flexibility to accommodate tree growth. Band 12 is bent through the slot 11*s* forming a bight or loop. The end of plate 21 is forced against the free end 20 to secure the free end against the bracket 11. The opposite end of strap 12, as shown in FIG. 2 is permanently attached to bracket 11 by a fastener 24.

In the normal operation of the bracket assembly 10 of this invention, the automatic adjustments in the tree circling loop 13 are made by adjustment of the loop 16 and the fastener 21 is then fixed. Manual adjustment may be necessary only after several years to provide additional length of band 12 in the loop 16.

Figure 6:
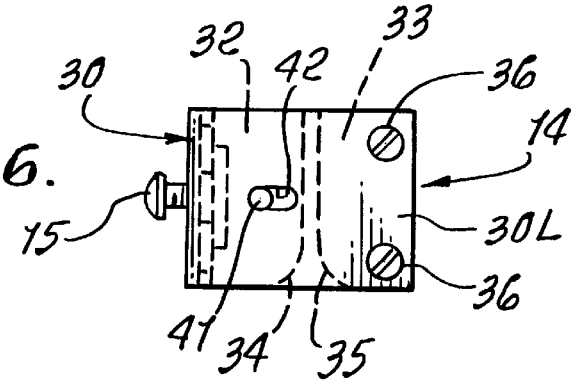
FIG. 6 is a top plan view of the secondary adjustment device of FIG. 4.
Figure 7:
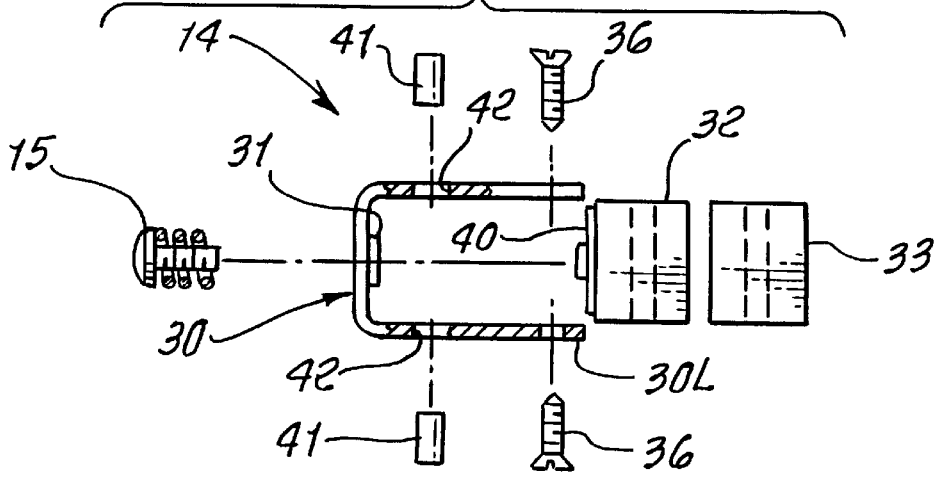
FIG. 7 is an exploded view of the adjusting device of FIG. 6.

The successful operation of this invention is keyed to making correct installation and adjustment of the clutch or tensioning device 14 which is best seen in FIGS. 6 and 7. This device 14 comprises a U shaped bracket 30 including a threaded receiver 31 for screw 15 and a pair of resilient plastic blocks 32 and 33. Both blocks 32 and 33 have smoothly rounded front edges 34 and 35 to accommodate the band or strap 12 as it enters the clutch 14. The block 33 is secured to the bracket 30 by two pairs of screws 36 which enter the block 33 via holes in the outer end of the legs 30L of the U shaped bracket 30. The plastic block 33 remains fixed in position at all times.

Tension adjustment to the clutch 14 is accomplished by means of a screw 15 bearing against a spring loaded pressure plate 40 on the near face of block 32. The block 32 is positioned within the U shaped bracket 30 while allowing longitudinal movement toward and away from block 33 responsive to screw 15 movements. It is restrained within the bracket 30 by a pair of pins 41 embedded in block 32 and captured in longitudinal slots of 42 of bracket 30. Only one slot 42 appears in FIG. 6 and FIG. 4. The other slot 42 is on the lower side of bracket 30.

The blocks 32 and 33 are preferably manufactured from material such as black nylon 6/6 which exhibits resilience as well as sufficient friction to hold the band 12 but allows tension on the band as the tree grows within loop 13 to draw the loop 16 through the tensioning device or clutch 14 overcoming the clutch action.

Perhaps the only visual observation needed within the first several months after installation is that the lighting fixture is being held securely and that the band is not unduly pressing into the bark of the tree. If so, a slight relief of band tension is obtained by a fractional counterclockwise turn of screw 15 to permit a short length of loop 16 to pass through clutch 14.

Each time the loop 16 is adjusted in size and the free end 20 shortened, a slight adjustment in adjusting screw 15 may be in order.

For larger fixtures, a pair of adjustment straps 12 may be necessary for secure mounting of the fixture. In such case, the same bracket may be used with the presence of tree encircling bands which are mounted similar to the assembly of FIG. 2, by securing them to upper and lower slots 50*s* on the bracket 11 which are indicated by dashed lined slots in bracket 11.

Figure 8:
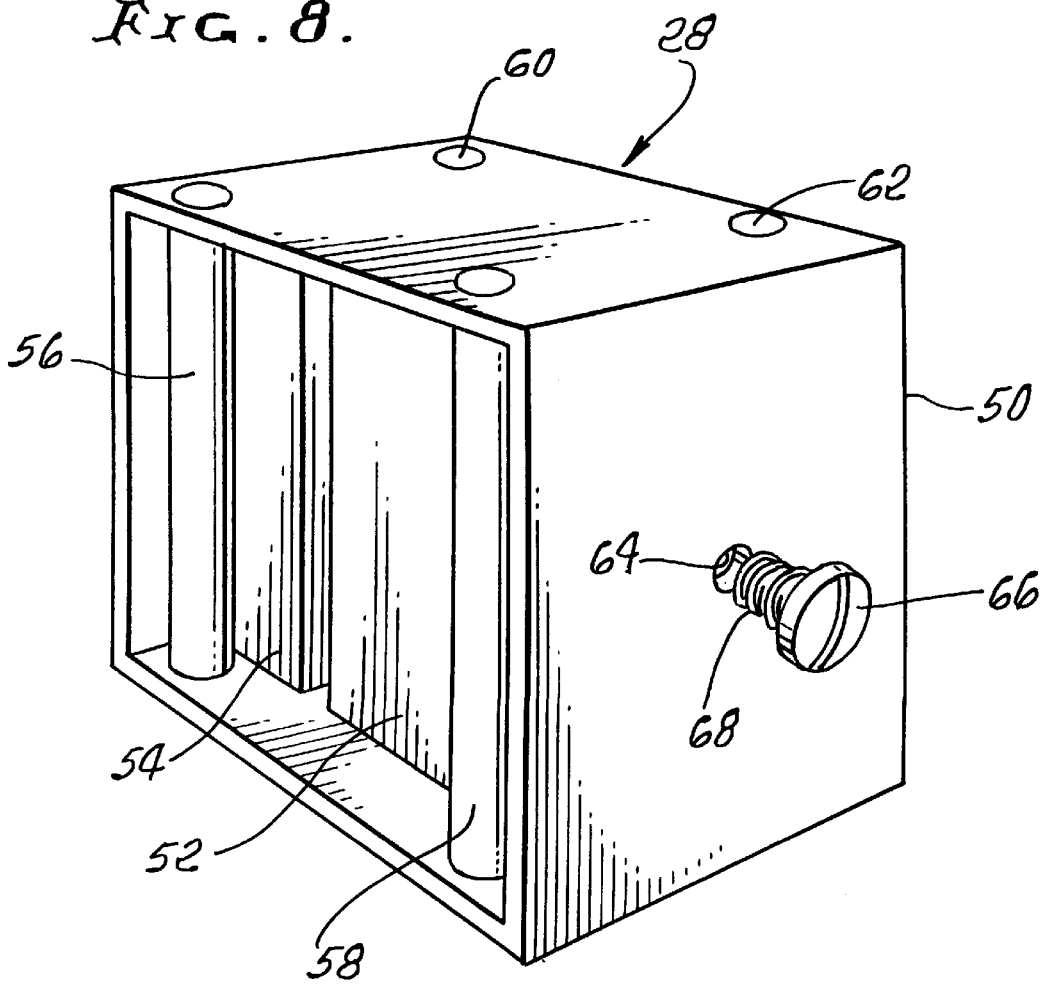
FIG. 8 is a perspective view of another embodiment of the clutch device of this invention.

FIG. 8 is a perspective drawing of another embodiment of clutch device of the invention. The clutch 28 includes a box-shaped housing 50 open on the ends, which may be either a plastic or an aluminum extrusion. Within housing 50 are blocks 52 and 54 which are captured in position by means of a plurality of cylindrical pins 56, 58, 60 and 62. Pins 60 and 62 are, or may be, identical to pins 56 and 58. These pins may be elongated screws or rod sections suitably secured to the top and bottom of housing 50. A port 64 in a wall of housing 50 is threadedly engaged with a screw 66 which is positioned to push against block 52 to force block 52 toward block 54. A spring 68 surrounds screw 66 to hold it in position. For clarity the band 70 (FIGS. 9 and 10) has not been shown in this view.

Figure 9:
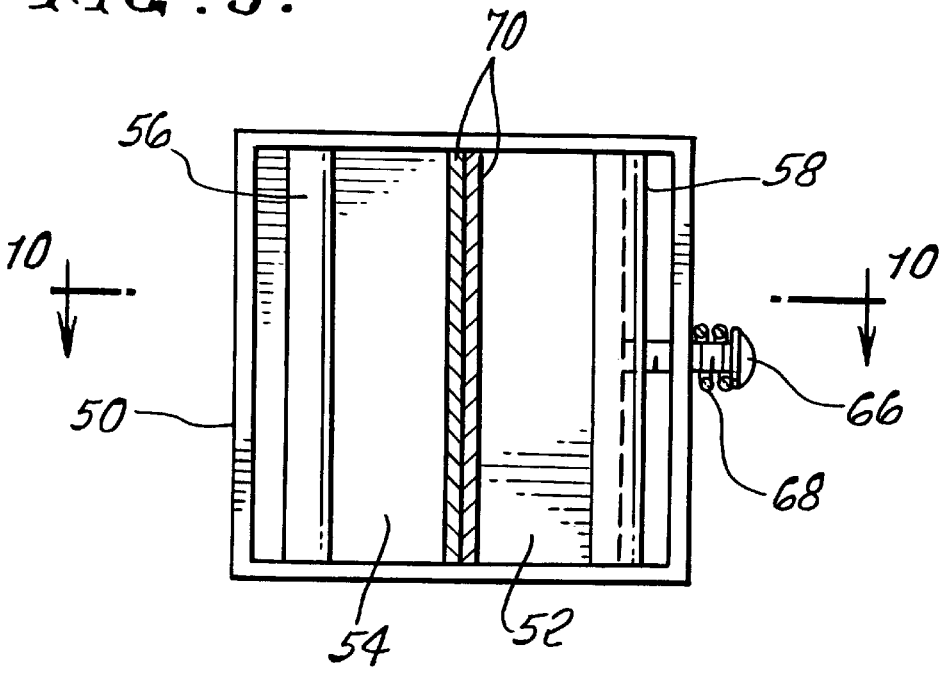
FIG. 9 is an end elevational view, partly in section, of the embodiment of FIG. 8.

FIG. 9 is an end elevational view of the embodiment of FIG. 8. In this view housing 50 is shown containing blocks 52 and 54 with two layers or parts of band 70 shown in section between the blocks. As shown in this view, screw 66 is turned inwardly sufficiently to compress spring 68 and to move block 52 to the left behind pin 58. One edge of block 52 is shown in dashed outline behind pin 58.

Figure 10:
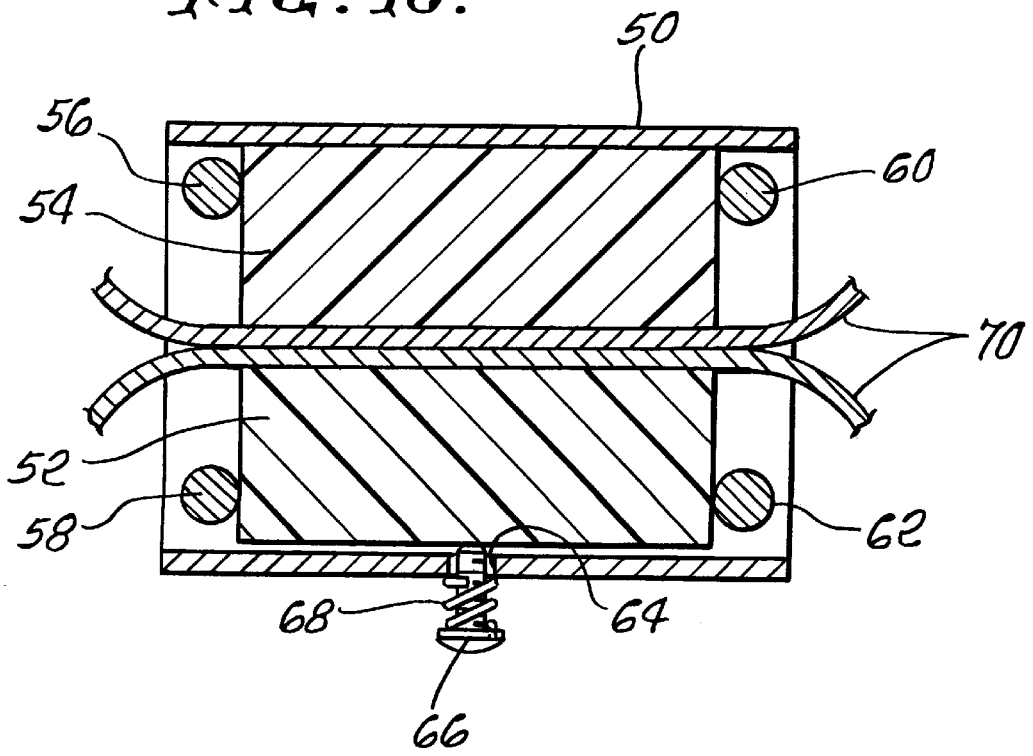
FIG. 10 is a sectional view taken along line 10—10 of FIG. 9.

FIG. 10 is a sectional view taken along line 10—10 of FIG. 9. In this view housing 50 and blocks 52 and 54 are shown in section. While these parts are sectioned for plastic, housing 50 might also be of aluminum. Blocks 52 and 54 are preferably of plastic. Band 70 is shown in section as of metal, although it could be made of a strong material such as woven Kevlar.

The foregoing embodiments are representative of the preferred form of this invention as presently known and are considered as exemplary and not as limiting. It is recognized that one following the teaching set forth above can design other variations which still fall within the scope of this concept and do not depart from the principles set forth herein. The scope to this invention therefore should not be considered as limited to the embodiments shown but rather to the following claims as construed with the benefit of the Doctrine of Equivalents.

We claim:

1. An assembly for mounting a light fixture on a tree comprising a plate for mounting said fixture including a mounting surface and a fastening means on each side of said mounting surface;

an elongated band of material having its ends secured to said fastening means;

a clutch including a pair of spaced blocks defining a slot, two layers of said band being pressed together in said slot, thereby defining a primary loop including said plate on one side of said clutch and a secondary loop on the opposite side of said clutch; and means for selecting the pressure of said blocks against said band layers to allow automatic expansion of said primary loop with growth of the tree.

2. An assembly as claimed in claim 1 wherein said fastening means includes flanges attached to said mounting surface and one end of said band is adjustably secured to one of said flanges.

3. An assembly as claimed in claim 2 wherein slots are formed in said flanges, and the ends of said band are passed through said slots.

4. An assembly as claimed in claim 3 wherein a locking plate and a screw are secured to one of said flanges and said band, after passing through said one of said slots is doubled over upon itself and held in position by said screw and said locking plate.

5. An assembly as claimed in claim 1 wherein said blocks are smoothly rounded at one end of said slot to minimize sharp bends of said band.

6. An assembly as claimed in claim 1 wherein said clutch includes a box-section housing, said blocks are positioned in said housing, a plurality of capture pins are positioned to retain said blocks in said housing, and a screw is threadedly engaged with said housing for varying the pressure of said blocks against said band layers.

7. An assembly as claimed in claim 6 wherein slots are formed in said flanges, and the ends of said band are passed through said slots.

8. An assembly as claimed in claim 7 wherein a locking plate and a screw are secured to one of said flanges and said band, after passing through one of said slots is doubled over upon itself and held in position by said screw and locking plate.

9. An assembly for mounting a lighting fixture on a tree comprising a plate for mounting a fixture, said plate including a fixture mounting surface with a band mounting means on each side of said fixture mounting surface;

an elongated band having its ends secured to said band mounting means; and a clutch including a generally U-shaped bracket, a first block secured in said bracket and a second block adjustably secured in said bracket and positioned to define a slot between said blocks, adjustment means positioned between said second block and said bracket;

two thicknesses of said band being pressed together and placed in said slot to provide a primary loop for securing said assembly to said tree and a secondary loop on the opposite side of said clutch, said adjustment means being adjustable to select the pressure of said blocks against said band layers to allow automatic expansion of said primary loop with growth of the tree.

10. An assembly, as claimed in claim 9, wherein said adjustment means comprises a spring, a pressure plate and a threaded member secured to said bracket and bearing against said pressure plate; said spring bearing against said bracket and said pressure plate to apply pressure against said band.

11. An assembly for mounting a lighting fixture on a tree comprising a plate for mounting said fixture, said plate including a mounting surface and mounting means at each side of said mounting surface;

an elongated band having its ends secured to said mounting automatically means thereby forming large single loop;

a clutch including a housing, a first block secured in said housing and a second block adjustably secured in said housing and positioned to automatically define a slot between said blocks, and an adjustment means secured to said housing bearing against said second block, two thicknesses of said band being pressed together and placed in said slot to provide a primary loop for securing said assembly to said tree and a secondary loop on the opposite side of said clutch, said adjustment means adjustable to vary the pressure of said blocks against said band to permit said band to pass through said clutch to compensate for growth of said tree.

12. An assembly as claimed in claim 11 wherein said clutch includes a box-section housing, said blocks are positioned in said housing, a plurality of capture pins are positioned to retain said blocks in said housing, and said adjustment means includes a screw threadedly engaged with said housing for varying the pressure of said blocks against said band layers.

13. An assembly as claimed in claim 11 wherein said mounting means comprises angled flanges and each said flange includes at least one slot, said band being of width to pass through said slots.

14. An assembly as claimed in claim 13 wherein one end of said band passes through one of said slots and is doubled over and fastened to itself by a fastener to secure said end of said band to one of said flanges and the other end of which passes through a slot in the other said flange, is doubled over and releasably secured to itself.

* * * * *